US005131618A

United States Patent [19]

Chapin

[11] Patent Number: 5,131,618

[45] Date of Patent: Jul. 21, 1992

[54] ELEVATED CHRISTMAS TREE TRACK

[76] Inventor: Michael J. Chapin, 2717 Twin Oak La., Modesto, Calif. 95355

[21] Appl. No.: 653,907

[22] Filed: Feb. 12, 1991

[51] Int. Cl.[5] ..... A47G 7/02

[52] U.S. Cl. ..... 248/523; 248/519; 47/40.5; 238/10 R

[58] Field of Search ..... 238/10 A, 10 R, 10 E, 238/10 F; 248/519, 523, 527, 188.2, 188.5; 104/124, 126; 47/40.5; 40/414, 430

[56] References Cited

U.S. PATENT DOCUMENTS

| | | | |
|---|---|---|---|
| 1,742,212 | 1/1930 | Muldoon | 248/527 X |
| 1,943,659 | 1/1934 | Eason | 47/40.5 |
| 2,190,544 | 2/1940 | Jarnagin | 248/523 |
| 2,874,496 | 2/1959 | Rakes | 248/523 X |
| 2,931,604 | 4/1960 | Weddle | 248/527 X |
| 3,051,094 | 8/1962 | Shames | 238/10 R X |
| 3,411,740 | 11/1968 | Schulz | 47/40.5 |
| 4,718,630 | 2/1988 | Richard | 248/188.2 X |
| 4,901,971 | 2/1990 | Connelly | 248/523 |
| 4,978,098 | 12/1990 | Peckinpaugh | 248/188.2 X |

FOREIGN PATENT DOCUMENTS

| | | | |
|---|---|---|---|
| 789401 | 7/1968 | Canada | 47/40.5 |
| 2152235 | 5/1973 | Fed. Rep. of Germany | 47/40.5 |
| 3609357 | 10/1987 | Fed. Rep. of Germany | 47/40.5 |
| 1211504 | 11/1970 | United Kingdom | 47/40.5 |

*Primary Examiner*—Robert J. Spar
*Assistant Examiner*—Robert S. Katz

[57] ABSTRACT

My invention provides the user with a new and innovative way to display a working model railroad train set traveling around a Christmas tree. My invention enables the user to elevate the train to a varying height to prevent any interference with the placements of gifts at the base of the tree, and also provides the means to place the model train out of the reach of small children and pets. The model train is supported on my invention by a track (FIG. 1) which is attached to supports (FIG. 1) connecting the track to the Christmas tree by an adjustable collar (FIG. 1) and by the use of support legs.

2 Claims, 6 Drawing Sheets

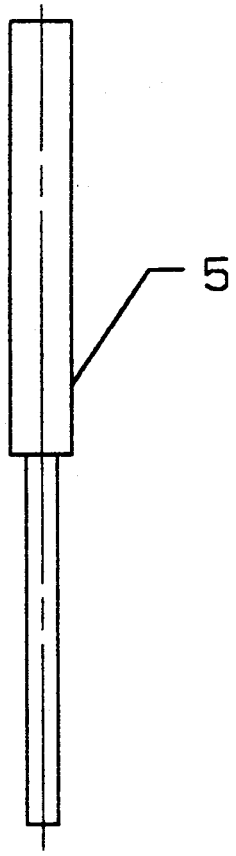
FIGURE 4A
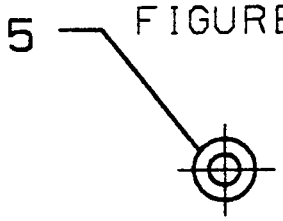
FIGURE 4B
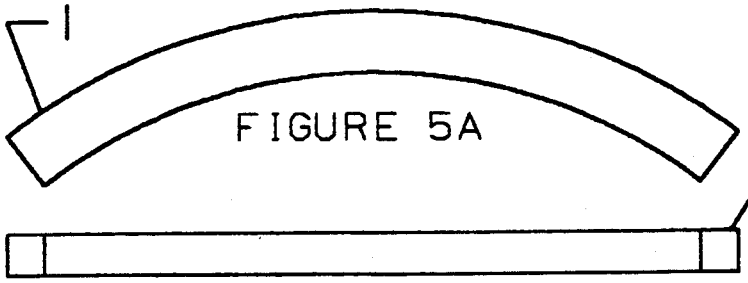
FIGURE 5A
FIGURE 5B
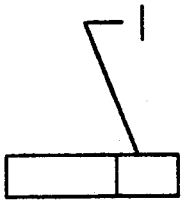
FIGURE 5C

ELEVATED CHRISTMAS TREE TRACK

BACKGROUND

1. Field of Invention

This invention relates to a hobby toy track installed around a Christmas tree.

2. Field of Invention

The problem to which my invention is directed was approached in the past by placing the hobby track at the base of the tree, on the floor. This placement of the hobby track on the floor has two distinct disadvantages;

(1) The placement of the hobby track on the floor enables small children or pets to obtain access to the track and its host objects like but not limited to a model railroad train set creating a potential hazardous situation and or a maintenance problem.

(2) The placement of the track on the floor also creates a interference problem with the common practice of placing Christmas gifts at the base of the tree on the floor beneath the tree.

OBJECTS AND ADVANTAGES

Accordingly, several objects and advantages of my invention are as follows;

(1) By placement of the track above the floor to a varying height enables one to place gifts at the base of the Christmas tree without interference with the track.

(2) The placement also allows the user to keep the track,and its host components,like but not limited to,a model railroad train set out of reach of small children and pets.

(3) The placement of the track at a higher level than the floor gives one a better visual contact with the track and its host components and gives the visual impression that the track and its host components are floating around the Christmas tree.

Further objects and advantages of my invention will become apparent from a consideration of the drawing and ensuing description of it.

FIGS. 4A and 4B show side and end views of the stabilizing legs.

FIGS. 5A–5C show the end, side, and tops views of the individual track sections.

DESCRIPTION OF INVENTION FOR THE PREFERRED EMBODIMENT

Figure 1A:
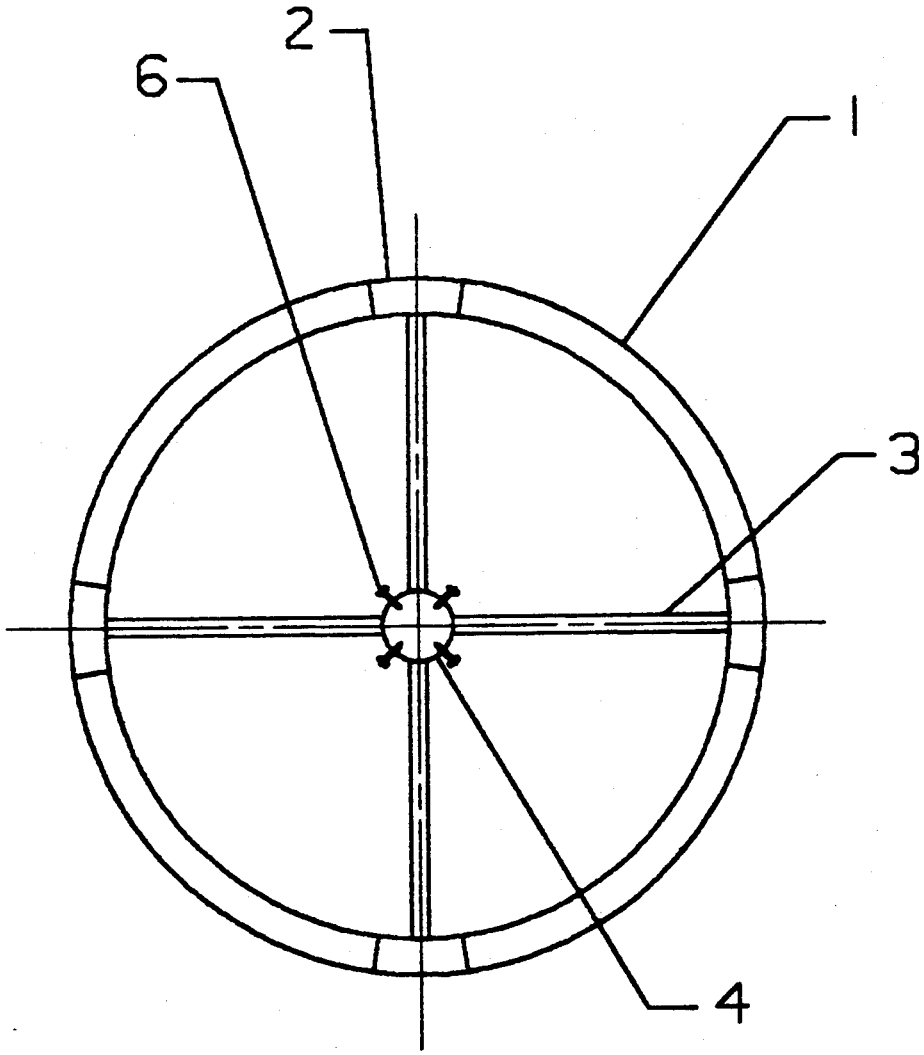
FIGS. 1A and 1B shows a top and side view, respectively, of the support system of my invention and its major components.
Figure 1B:
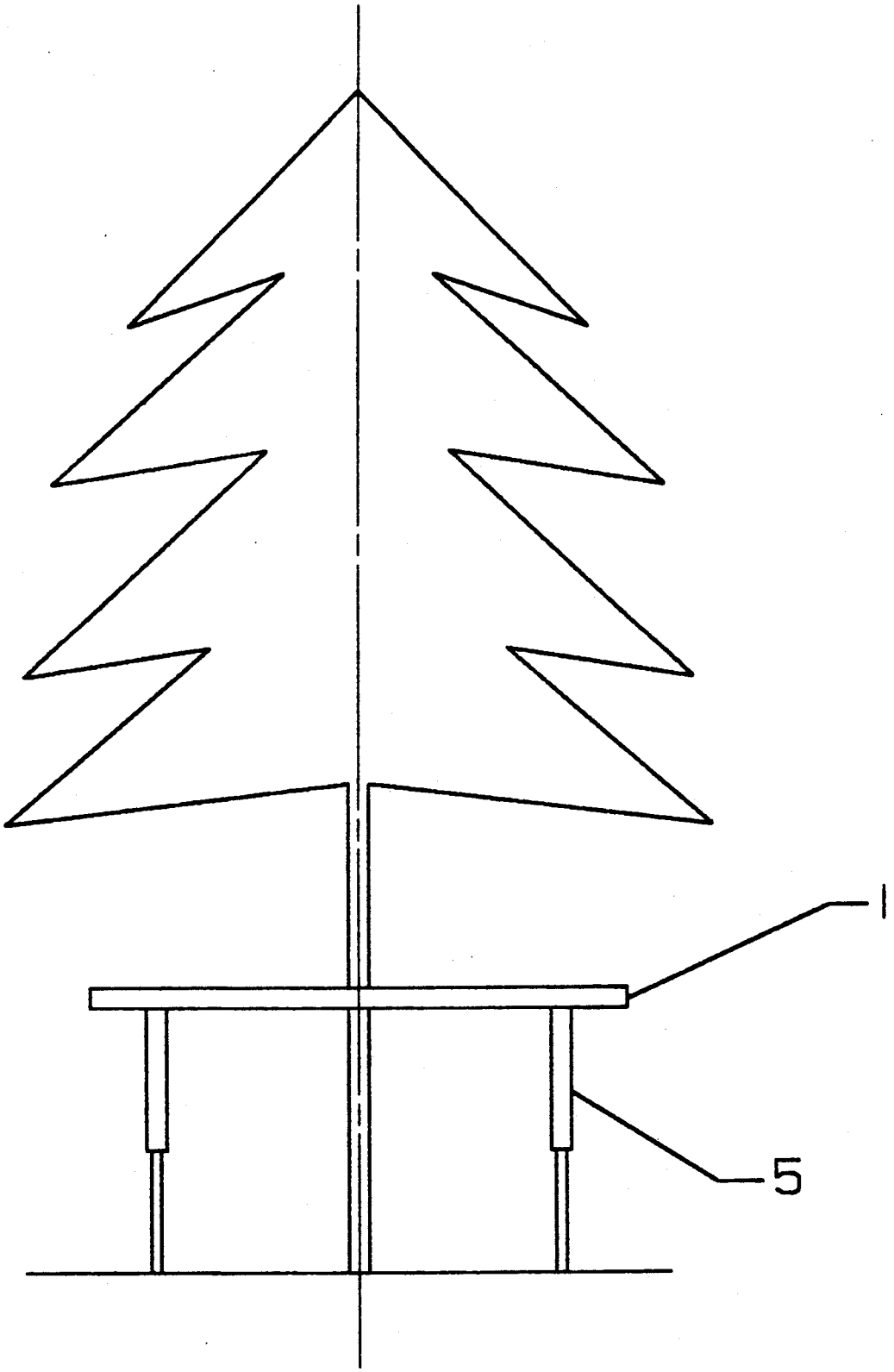
Figure 2A:
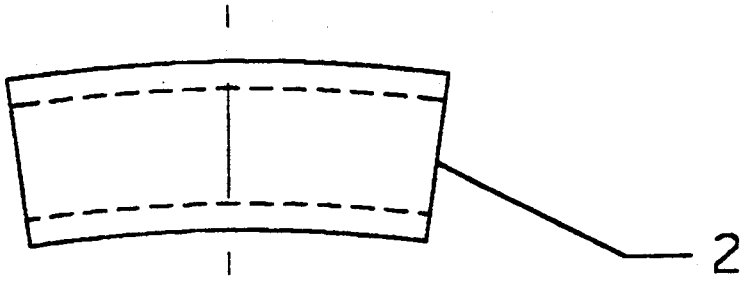
FIGS. 2A–2C show details of the track connectors showing a top, side, and end views respectively.
Figure 2B:
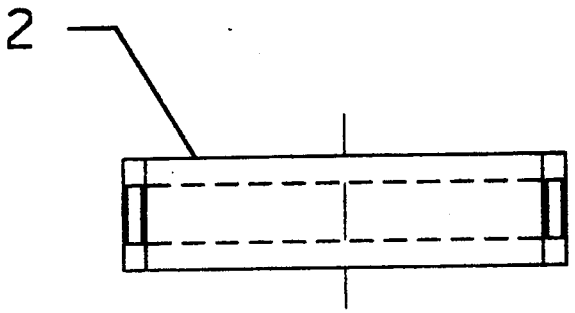
Figure 2C:
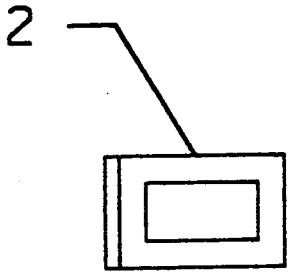
Figure 3A:
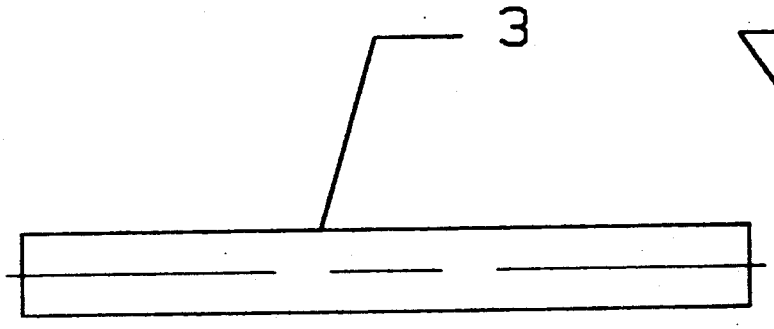
FIGS. 3A and 3B show side and end views of the support members.
Figure 3B:
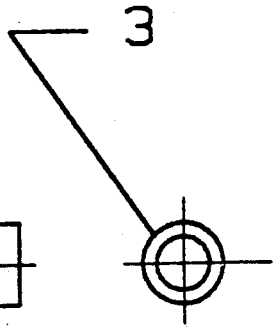
Figure 6A:
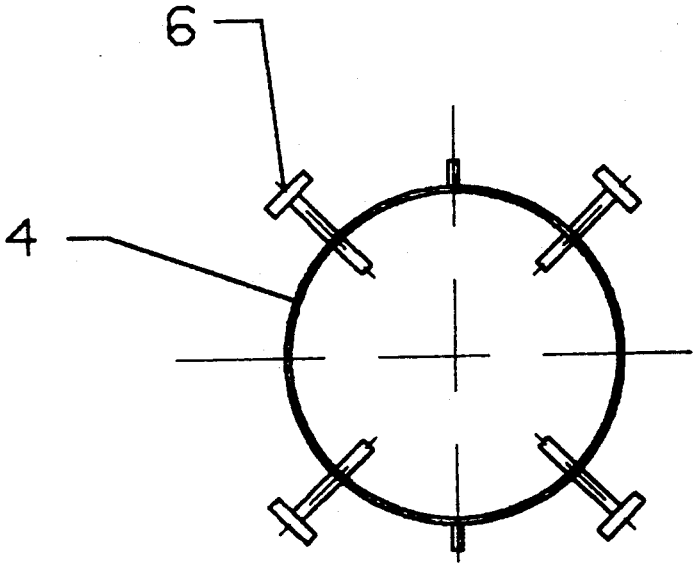
FIGS. 6A–6C show side, top, and exploded views of the adjustable connection collar.
Figure 6B:
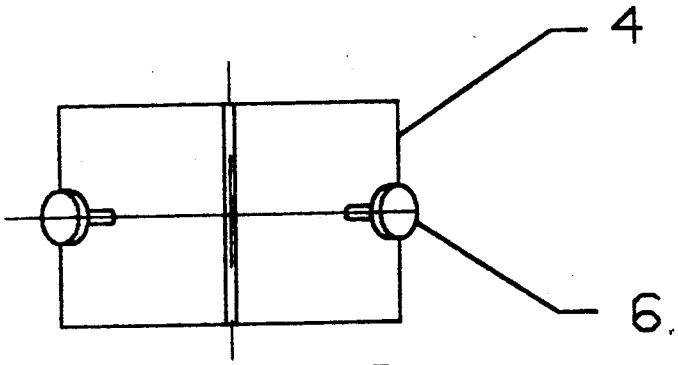
Figure 6C:
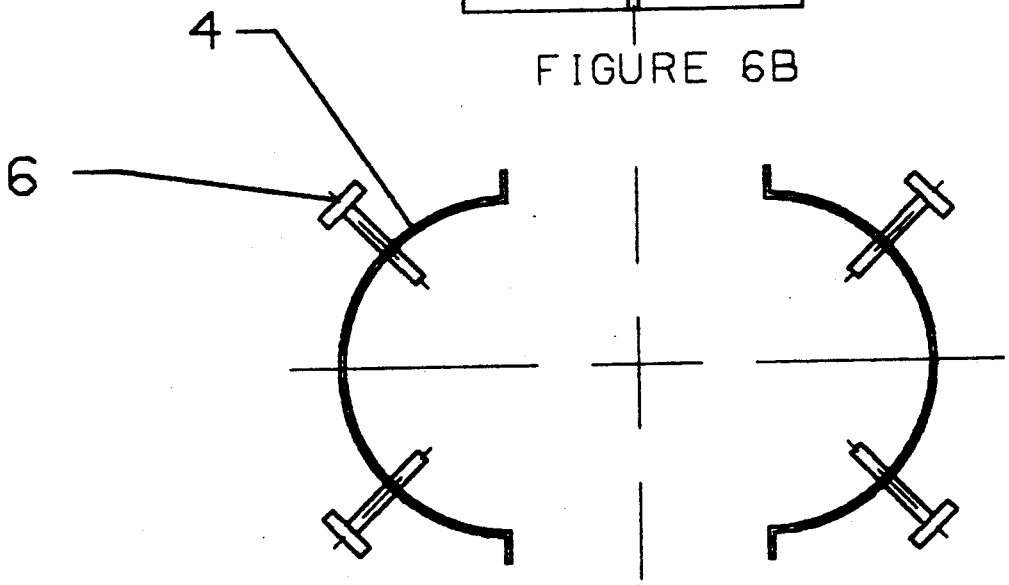

FIG. 1 shows the side and top view of my invention. The track is made up of 4 pieces (1) when combined form a circular track. The sections are joined together with track connectors (2) which are detailed in FIG. 2. FIG. 1 also shows four track supports (3) radiating inward and connected to a adjustable collar (4) which is inturn designed to connect to the trunk of a Christmas tree. Furthermore FIG. 1 shows stabilization legs (5) protruding downward to the floor.

DESCRIPTION OF INVENTION FOR A SECOND EMBODIMENT

Figure 7A:
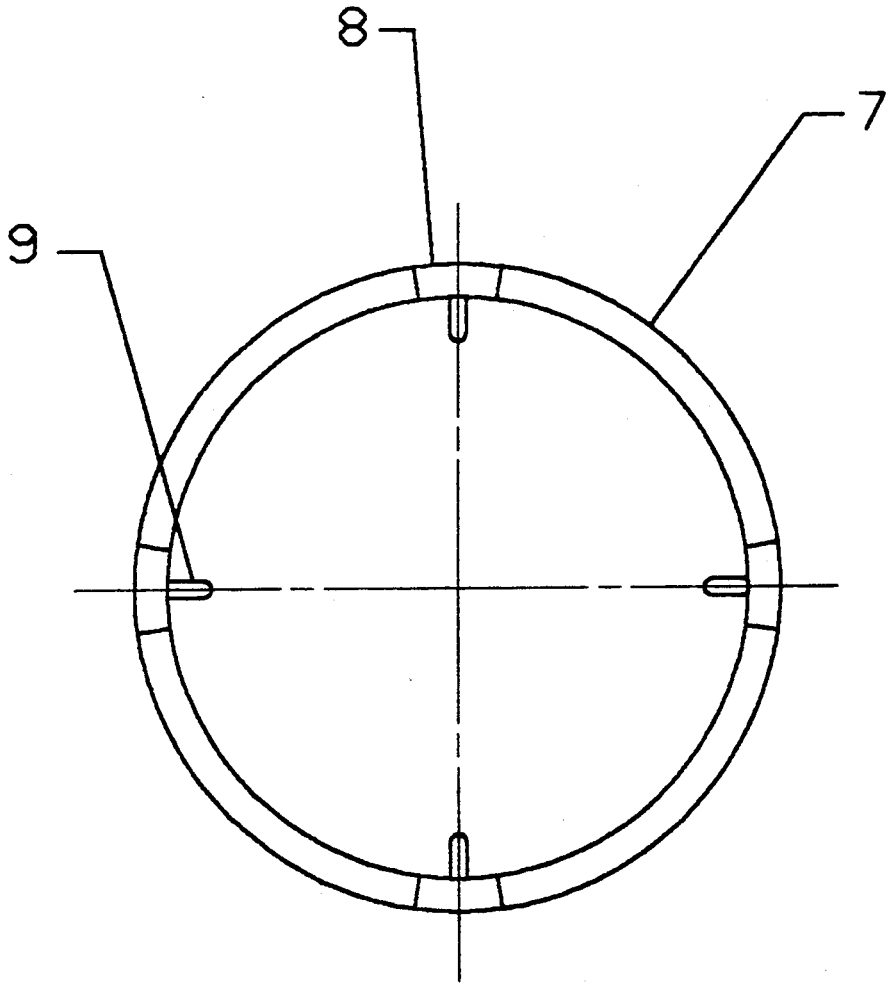
FIGS. 7A and 7B, show a top and a side view of a second embodiment of a support system.
Figure 7B:
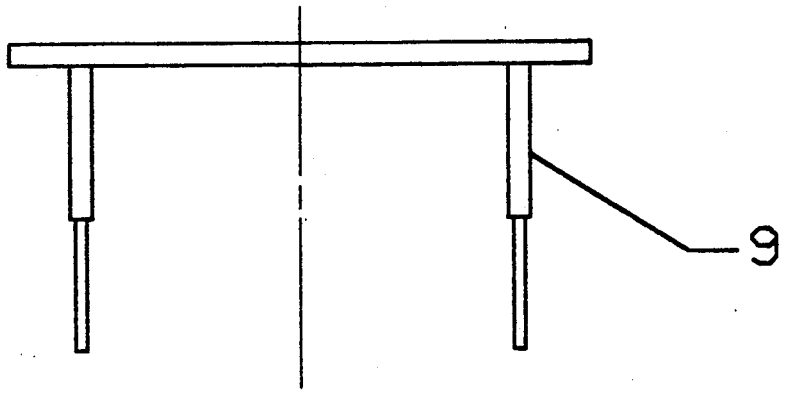

FIG. 7 shows another embodiment with circular sections (7), connectors (8), and adjustable legs (9) without an adjustable collar or means to directly attach the support system to a Christmas tree.

OPERATION OF INVENTION

The operation of my invention is simple, it supports a track around a Christmas tree enabling a host object like but not limited to a model railroad train set to operate without the problems stated in the objects and advantages section of this application.

CONCLUSION, RAMIFICATIONS, AND SCOPE OF INVENTION

In conclusion, one can see that my invention provides the user a very effective highly reliable and econmical means to support a elevated host object like a model railroad train set solving the problems of interference with gifts, and to keep the objects out of reach of children and pets. The visual effect of a model train traveling around the Christmas tree brings joy to both adults and children alike and I feel my invention enhances this joy to a considerable degree, and is a very novel way of accomplishing this.

CONCLUSION, RAMIFICATION, AND SCOPE OF INVENTION

While my above description contains many specificites, these should not be construed as limitations on the scope of the invention, but rather as an exemplification of one prefered embodiment thereof. Many other variations are possible, for the support of my track could be accomplished by hanging it from the ceiling, or weights could be added to the track to prevent tree movement while the train travels around the track but I feel my application embodies the most efficient means to accomplish this task.

Accordingly the scope of the invention should be determined not by the embodiments illustrated, but by the appended claims and their legal equivalents.

I claim:

1. A support system for supporting objects above a floor and around a Christmas tree with a trunk, said support system comprising:

(a) a rigid circular support comprised of a plurality of curved sections, said circular support having a substantially planar upper support surface;

(b) a plurality of connectors to connect said curved sections together to form a substantially circular shape having an origin;

(c) a plurality of elongated height adjustable stabilizing legs connected to said curved sections to support said circular support a distance above the floor;

(d) a plurality of rigid elongated support members radiating inward toward said origin from said curved members;

(e) a rigid adjustable collar connected to said elongated support members for connecting said support system to various diameters of Christmas tree trunks; and (f) wherein said support system allows the user to attach the circular support to a Christmas tree at various heights along its trunk and allowing objects to be placed on said planar upper support surface to place said objects safely above said floor.

2. A support system as claimed in claim 1, wherein one of said objects is a moving model train.

* * * * *